United States Patent [19]

Bagepalli et al.

[11] Patent Number: 4,656,445

[45] Date of Patent: Apr. 7, 1987

[54] HIGH SPEED CONTACT DRIVER

[75] Inventors: Bharat S. Bagepalli; Imdad Imam, both of Schenectady, N.Y.; Edward K. Howell, Simsbury, Conn.

[73] Assignee: General Electric Company, Schenectady, N.Y.

[21] Appl. No.: 876,132

[22] Filed: Jun. 19, 1986

[51] Int. Cl.[4] ..... H01H 77/10

[52] U.S. Cl. ..... 335/195; 335/16; 200/147 R

[58] Field of Search ..... 335/195, 147, 16; 200/147

[56] References Cited

U.S. PATENT DOCUMENTS 3,002,065 9/1961 LaTour, Jr. ..... 200/87

3,168,626 2/1965 Patrick ..... 200/87

3,215,796 11/1965 Leisi ..... 200/91

4,375,021 2/1983 Pardini et al. ..... 200/147 B

*Primary Examiner*—Harold Broome

*Attorney, Agent, or Firm*—William H. Steinberg; James C. Davis, Jr.; Paul R. Webb, II

[57] ABSTRACT

A high speed contact driver for use in an electrical circuit interrupter includes a pair of series-connected, elongate and generally opposing electrical conductors bowed in predetermined, generally opposing contours. These conductors are connected to a bridging electrical contact which is normally biased into a bridging position between a pair of stationary contacts. Pulse generating means are provided for applying a current pulse of predetermined magnitude to the electrical conductors. In response to this current pulse, these electrical conductors electromagnetically repulse each other and drive the bridging contact out of bridging position between the stationary contacts.

13 Claims, 8 Drawing Figures

HIGH SPEED CONTACT DRIVER

RELATED APPLICATIONS

This application is related to commonly assigned application Ser. No. 684,307, filed Dec. 20, 1984, inventor E. K. Howell, the entirety of which is incorporated herein by reference.

Application Ser. No. 684,307, is now abandoned and application Ser. No. 814,865, filed Dec. 30, 1985 is a substitute.

BACKGROUND OF THE INVENTION

This invention relates in general to electrical circuit interrupters and in particular to a high speed contact driver for use in current limiting circuit interruption devices.

In the past, typical alternating current circuit breakers required the creation of a large mechanical gap between two electrical conductors, and could only interrupt an alternating current at a zero-crossing. More recently developed current limiting circuit interrupters, for example of the type shown in U.S. Pat. No. 4,375,021 to Pardini et al. (assigned to the assignee of the present invention and incorporated herein by reference), provide the capability of substantially immediately interrupting alternating currents of high magnitude without waiting for a current zero-crossing. These current limiting interrupters are typically complex in construction, and thus somewhat expensive to fabricate.

The above referenced application Ser. No. 684,307 (hereinafter referred to as "Howell") discloses a high speed contact driver for use in current limiting circuit interrupters. The contact driver of Howell, described in detail below, uses a pulse of current applied to a pair of closely spaced electrical conductors to cause these conductors to electromagnetically repulse one another and lift a bridging contact away from a pair of stationary contacts.

While Howell provides fast and reliable separation of electrical contacts, the nature of current limiting interrupters is such that faster, more reliable interruption is always better. Thus, any improvement over Howell which provides for faster, more reliable circuit interruption provides a substantial benefit to the art.

OBJECTS OF THE INVENTION

Accordingly, a principal object of the present invention is to provide a high speed contact driver which is relatively faster and more reliable than those shown in the prior art.

Another object of the present invention is to provide a high speed contact driver which is relatively simple in design and inexpensive to manufacture.

A further object of the present invention is to provide a high speed contact driver which is particularly adapted for use in a current limiting circuit interrupter.

SUMMARY OF THE INVENTION

A new and improved high speed contact driver for electrical circuit interruption is provided wherein a pair of series-connected, elongate and generally opposing electrical conductors are bowed in predetermined, generally opposing contours to increase the speed with which the contact driver operates. In addition to the pair of bowed electrical conductors, the inventive contact driver further includes a wire for conducting a main current, means for interrupting the current flow through the wire, and circuit means connected to the pair of electrical conductors for applying a current pulse of predetermined magnitude thereto. The bowed electrical conductors are connected between the circuit means and the current interrupting means such that when a current pulse is applied to these conductors by the circuit means, these conductors electromagnetically repulse one-another and cause the current interrupting means to interrupt the flow of main current through the wire.

In a preferred embodiment of the invention, the means for interrupting the current comprises a pair of stationary, spaced apart contacts disposed in the wire so as to interrupt the current flowing therethrough, and a bridging contact connected to the pair of electrical conductors and shaped to bridge said stationary contacts. The pair of electrical conductors comprises, alternatively, relatively stiff wire bowed in a predetermined contour, or relatively flexible wire bowed by an intermediately disposed wedge.

BRIEF DESCRIPTION OF THE DRAWINGS

While the specification concludes with claims defining the features of the invention that are regarded as novel, it is believed that the invention, together with further objects thereof, will be better understood from a consideration of the following description in conjunction with the drawing Figures, in which:

DETAILED DESCRIPTION OF THE PREFERRED EMBODIMENT

Figure 1:
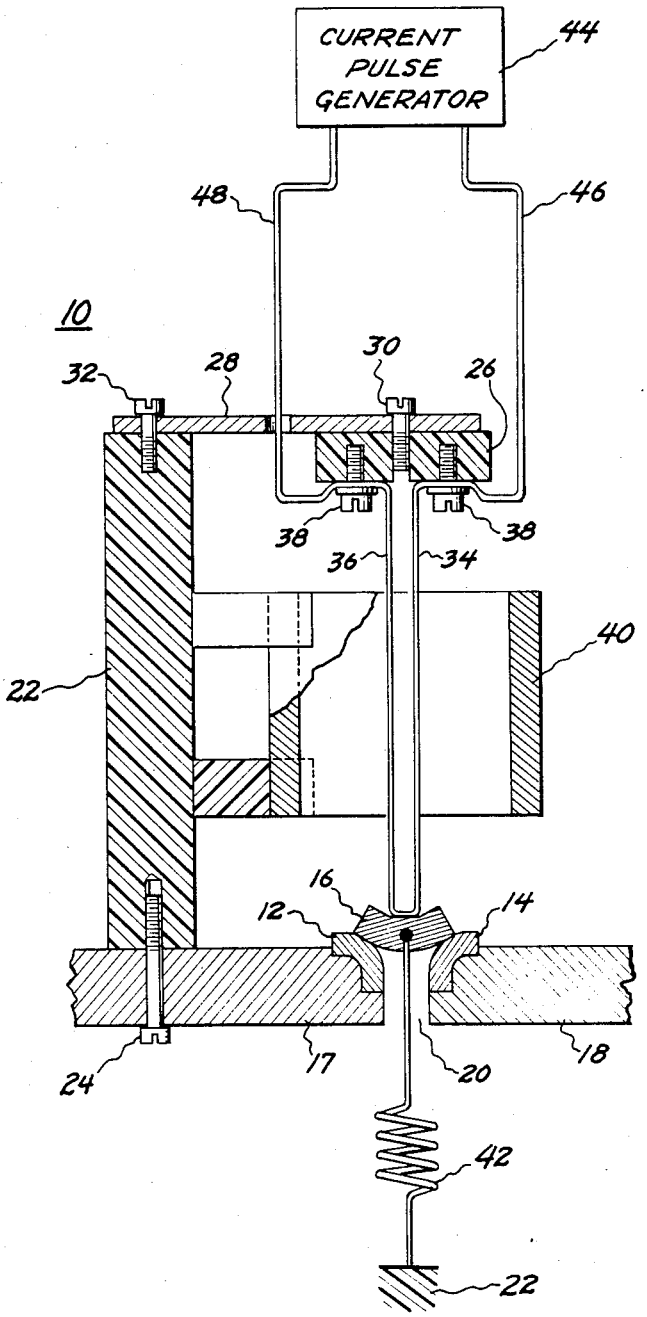
FIG. 1 illustrates a cross-sectional plan view of a high speed contact driver constructed in accordance with Howell.

Referring now to FIG. 1, a high speed contact driver 10 is shown comprising a pair of spaced-apart, stationary contacts 12 and 14 connected by a bridging contact 16 shown situated in a bridging, or closed position therebetween. Stationary contacts 12 and 14 are disposed on the ends of spaced, rigid, and generally straight main current carrying wires 17 and 18, the stationary contacts establishing an interruption 20 therebetween. Wires 17 and 18 and stationary contacts 12 and 14 comprise a conductive metal, such as copper. Bridging contact 16 is selected to have a predetermined mass $M_1$, and preferably comprises a solid metal such as copper. Alternatively, bridging contact 16 need only comprise sufficient metal to bridge the gap between stationary contacts 12 and 14.

Rigid wire 17 is fastened to an insulating frame 22 by a screw 24, the insulating frame preferably comprising a plastic. Rigid wire 18 is fixed relative to rigid wire 17, for example, by an insulating brace (not shown) to insulating frame 22. A block of insulating material 26, having a predetermined mass $M_2$, is attached to one end of a cantilever spring 28 by means of a screw 30, the opposite end of the cantilever spring in turn being attached to frame 22 by a screw 32. Mass $M_2$ of block 26 is selected to be relatively much heavier than mass $M_1$ of bridging contact 16. Bridging contact 16 is connected at one end of each of a pair of series-connected, parallel, elongate, and generally opposing electrical conductors 34 and 36, each of the electrical conductors being connected at an opposite end, via a screw 38, to a block 26. Electrical conductors 34, 36 comprise flexible material, for example a thin copper wire. The series connection between conductors 34 and 36 is shown as established by bending a single conductor 34–36 in half at bridging contact 16. Alternatively, the series connection can be made between conductors 34 and 36 through the metal in bridging contact 16. A magnetic yoke 40, comprising a magnetic material such as iron, is supported by frame 34 and surrounds a portion of conductors 34 and 36 for establishing a magnetic field thereabout.

A biasing means, for example a spring 42, is attached between bridging contact 16 and a fixed point, preferably frame 22, for biasing bridging contact 16 into the illustrated bridging position between stationary contacts 12 and 14. Spring 42 is selected to provide sufficient tension to hold bridging contact 16 in good electrical contact with stationary contacts 12 and 14, while working in opposition to the force exerted by cantilever spring 28 on the bridging contact via conductors 34 and 36. A current pulse generator 44, shown schematically in FIG. 1 and comprising one of many conventional generators known in the art, is connected to conductors 34 and 36 via a pair of leads 46 and 48, respectively, at screws 38.

Figure 2:
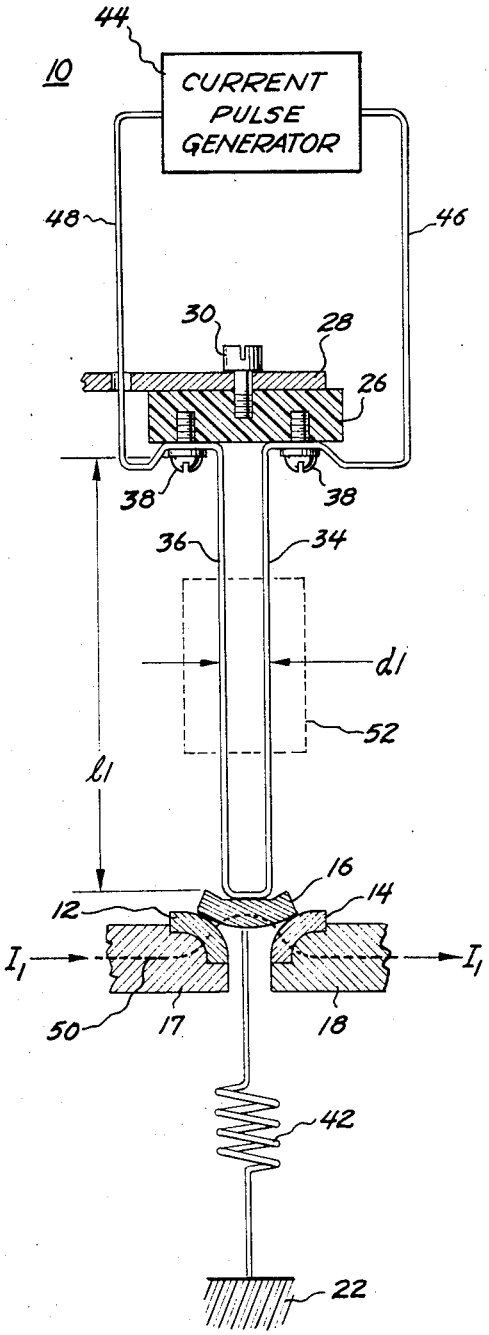
FIGS. 2 and 3 illustrate cross-sectional plan views of a portion of the contact driver of FIG. 1 before and after excitation, respectively.
Figure 3:
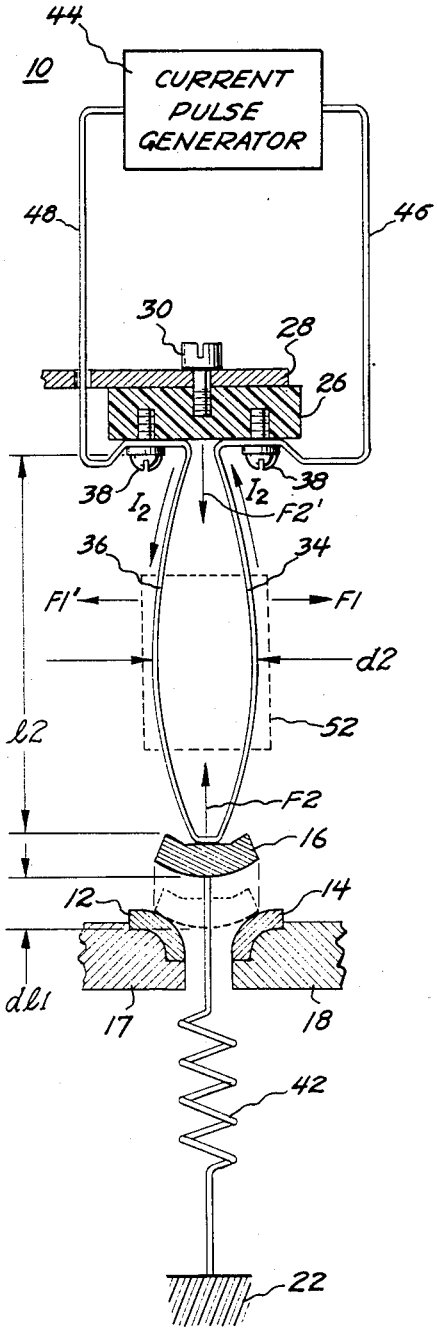

FIGS. 2 and 3 show the operation of contact driver 10 as it would occur when implemented in a current limiting circuit interrupter (not shown) of the type wherein a main current $I_1$ is conducted in wires 17 and 18.

FIG. 2 shows contact driver 10 with no current flowing in electrical conductors 34 and 36, and hence with bridging contact 16 biased by spring 42 into the closed position to create a path for current $I_1$ as indicated by dashed-line 50. For purposes of clarity, portions of contact driver 10 are omitted from FIGS. 2 and 3, and the magnetic field generated by yoke 40 is shown exerted across a central section of electrical conductors 34 and 36 as a dashed-line rectangle 52.

In FIG. 3, contact driver 10 is shown with a current pulse $I_2$, for example a pulse in the range of from 800–1,000 amperes, flowing through conductors 34 and 36 in the indicated direction. Current pulse $I_2$ is selected to be of sufficient magnitude to establish respective, opposing electromagnetic forces $F_1$ and $F_1'$ on conductors 34 and 36, respectively, these forces operating to move bridging contact 16 to the illustrated open position (i.e., spaced apart from stationary contacts 12 and 14). With bridging contact 16 spaced from stationary contacts 12 and 14 by an incremental distance $d1_1$, the separation distance $d_2$ between conductors 34 and 36 is substantially larger than the initial separation distance $d_1$ (FIG. 2). The length of distances $d1_1$ and $d_2$ are determined by the power of repulsive forces $F_1$ and $F_1'$, these forces being proportional in magnitude to the product of the magnitude of current pulse $I_2$ and the strength exerted by magnetic field 52. The force on bridging contact 16 is represented by the force vector $F_2$ and is exerted in the indicated direction towards block 26, an equal magnitude force $F_2'$ being exerted in the opposite direction on the mass. The dynamics of the operation of contact interrupter 10, in part determined by the relative masses of block 26 and bridging contact 16 and the strength of spring 42, insures the rapid motion of bridging contact 16. In a typical implementation of contact driver 10, bridging contact 16 is capable of moving from the closed to the open position in the range of from 10–100 microseconds.

In constructing contact driver 10, the length $l_1$ of conductors 34 and 36 and the separation distance $d_1$ therebetween is selected to ensure that when current pulse generator 44 is used to generate a current pulse of a predetermined magnitude, sufficient electromagnetic repulsion is produced between the two conductors to overcome the bias provided by spring 42 and thus to rapidly separate bridging contact 16 from stationary contacts 12 and 14. These length, separation distance, and pulse magnitude parameters are preferably further selected to insure that this separation occurs within a time increment in the range of 10–100 microseconds from the initiation of current pulse $I_2$.

Figure 4:
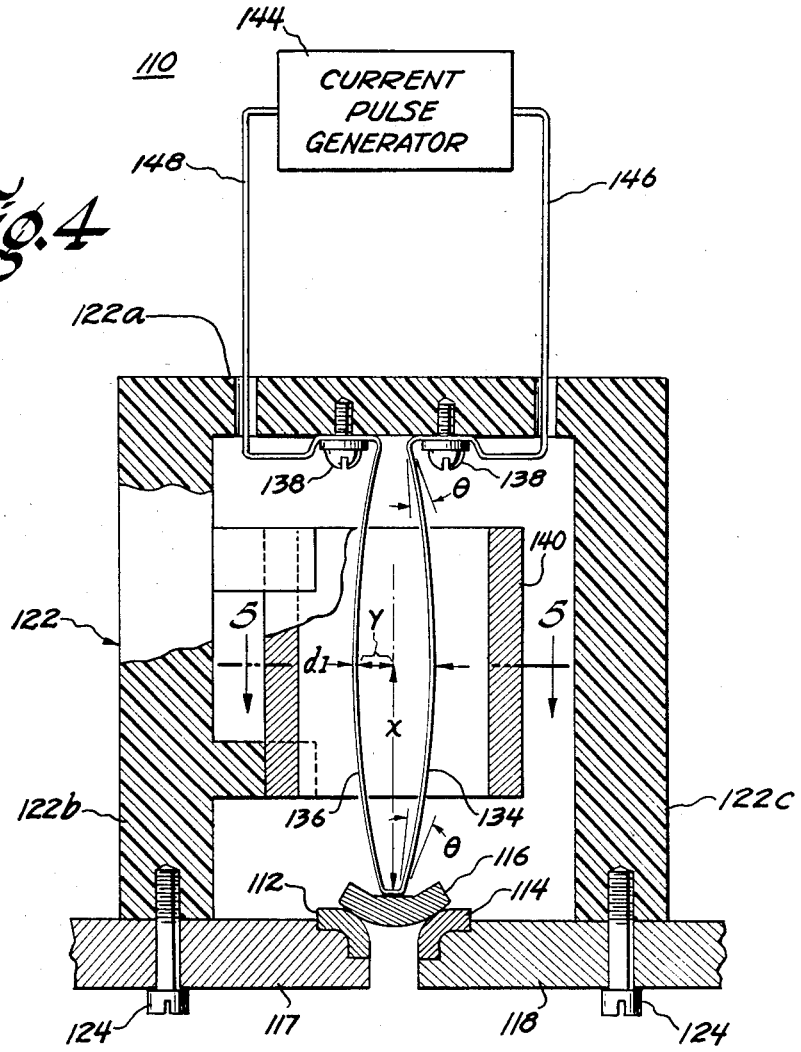
FIG. 4 illustrates a cross-sectional plan view of an embodiment of a high speed contact driver constructed in accordance with the present invention.
Figure 5:
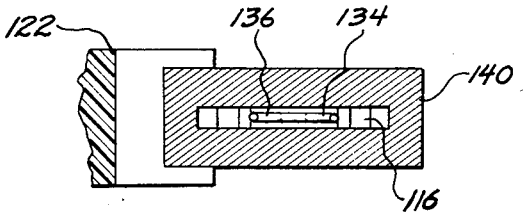
FIG. 5 illustrates a sectional view taken along line 5—5 of FIG. 4.

Referring now to FIGS. 4 and 5, a high speed contact driver 110 is shown constructed in accordance with one embodiment of the present invention. Features similar to those of contact driver 10 (FIGS. 1–3) are indicated by like reference numerals incremented by 100.

In contact driver 110, conductors 134 and 136 are each connected directly to the base end **122*a* of a generally U-shaped insulating frame 122 (i.e., without intervening mass 26 and cantilever spring 28 of FIGS. 1–3), and are each bowed in a generally opposing, predetermined contour X,Y when bridging contact 116 is in the closed position (FIG. 4). Main current conducting wires 117 and 118 are supported by legs 122*b* and 122*c* of frame 122, respectively, via screws 124. The predetermined contour X,Y establishes an angle $\theta$ between each end of conductors 134 and 136 and that ends' respective connection to frame 122 or bridging contact 116. In this embodiment of the invention, predetermined contour X,Y is established through the use of relatively stiff wire for conductors 134 and 136. This wire is selected to be stiff enough to maintain contour X,Y when bridging contact 116 is in the closed position, and flexible enough to yield to the previously described electromagnetic forces which act on conductors 134 and 136 when a current pulse is applied thereto. This wire is also preferably selected to be resilient enough such that no spring (i.e., spring 42 of FIGS. 1–3) is required to bias bridging contact 116 into the normally closed position, making a spring optional in this embodiment of the invention. Such wire comprises, for example, phosphor-bronze spring wire of 0.025 inch thickness bowed by compression to a predetermined contour X,Y defining a 6 inch radius. The remaining features of contact driver 110 are substantially identical to the analogously numbered features of contact driver 10 (FIGS. 1–3**).

Figure 6:
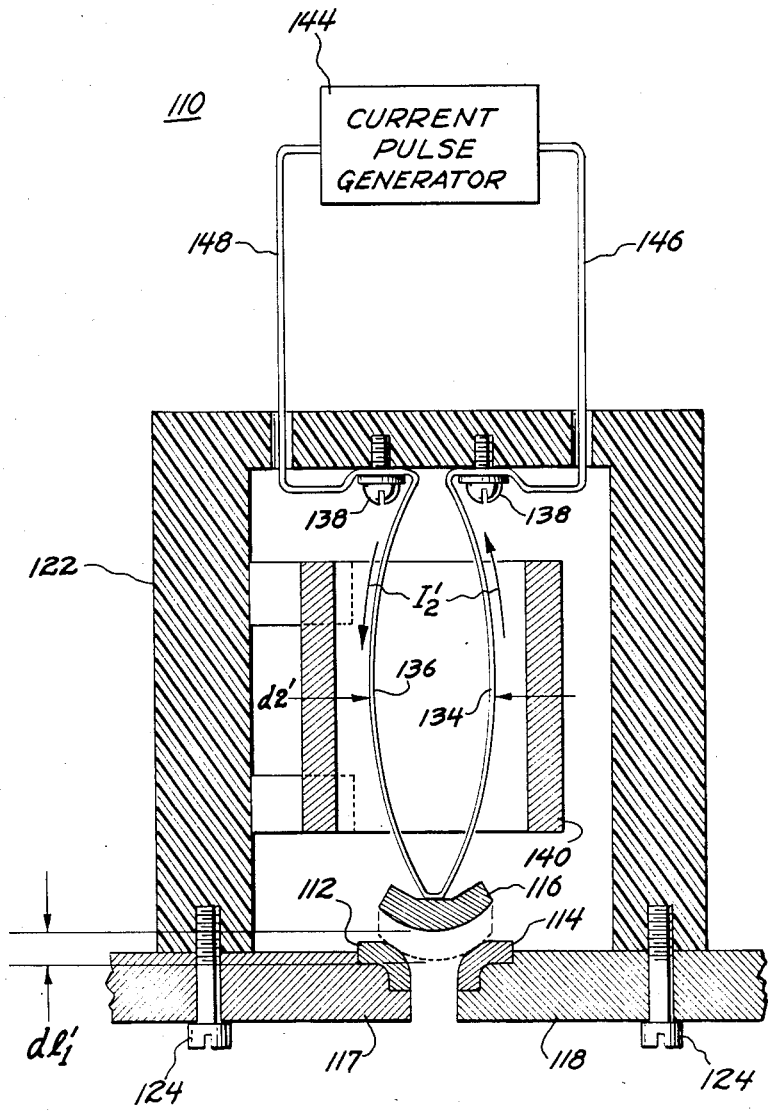
FIG. 6 illustrates a portion of the contact driver of FIG. 4 with the contact in an open position.

In operation, described with respect to FIG. 6, when a current pulse $I_2'$ is generated by pulse generator 144 through conductors 134 and 136, the bowed configuration of the conductors causes bridging contact 116 of contact driver 110 to open substantially faster than contact driver 10 (FIGS. 1–3). This is theorized as being due to two synergistic causes. First, the initial angle $\theta$ at the ends of conductors 134 and 136 increases considerably, with respect to the Howell embodiment of FIGS. 1–3 above, the rate of change of contact displacement $d1_1'$ with respect to wire displacement $d_2'$. This is believed to have a particularly large effect in the early stages of the opening of bridging contact 116. Second, the pre-bowed contour X,Y of conductors 134 and 136 eliminates the time required to establish angle $\theta$, the angle being required before any movement of bridging contact 116 can occur. In addition to the substantial advantage of increased opening speed, the predetermined contour X,Y in conductors 134 and 136 eliminates the requirement for a dynamically moving mass (i.e., block 26 and cantilever spring 28 of FIGS. 1–3) between the conductors and frame 134. This combined elimination of spring 42, cantilever spring 28 and mass 26 (FIGS. 1–3) makes contact driver 110 more economical to construct, and more reliable in operation than contact driver 10 (FIGS. 1–3). Further, the elimination of this mass and spring reduces the affect of gravity on the dynamics of the operation of contact driver 110, and thus permits the contact driver to operate reliably through a broader range of orientations than contact driver 10.

Figure 7:
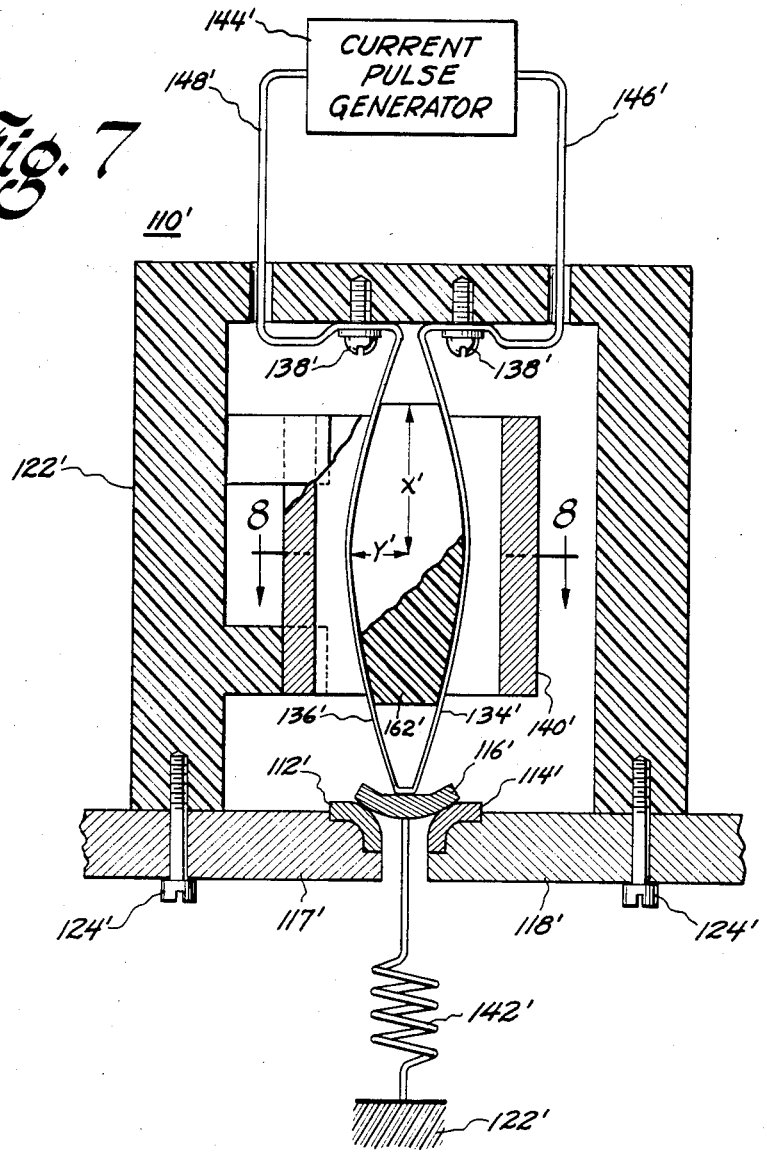
FIG. 7 illustrates a cross-sectional plan view of an alternate embodiment of the invention.
Figure 8:
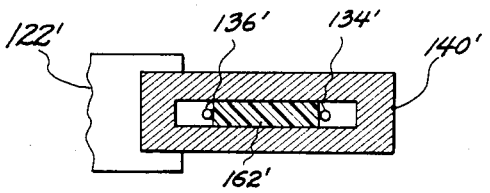
FIG. 8 illustrates a sectional view taken along line 8—8 of FIG. 7.

Referring now to FIGS. 7 and 8, an alternate embodiment of the invention is shown wherein features similar to those of FIGS. 4–6 are indicated by like, primed reference numerals.

Contact driver 110' is substantially identical in construction to contact driver 110 of FIGS. 4–6, with the exception of the construction of electrical conductors 134' and 136', the inclusion of an insulated wedge 162' situated therebetween, and the inclusion of a spring 142' disposed between bridging contact 116' and frame 122'. In accordance with this embodiment of the invention, conductors 134' and 136' each comprise wire having a low bending stiffness and which thus can easily conform to the shape of wedge 162'. Such a flexible wire comprises, for example, metal coated graphite bundles of 26 mil total diameter. Insulated wedge 162', has a selected, predetermined contour X',Y', and is disposed within yoke 140' between conductors 134' and 136' for establishing a substantially identical contour X',Y' in the conductors.

The operation of contact driver 110' is similar to that of contact driver 110 (FIGS. 4–6), with the exception that the bowed shape of conductors 134' and 136' is established by wedge 162'. Further, spring 142' is no longer optional, some biasing means being required to situate bridging contact 116' in the closed position illustrated in FIG. 7. The use of flexible wire for electrical conductors 134' and 136', in combination with wedge 162' for establishing the predetermined contour X',Y', permits the operation of contact driver 110' to be tailored to specific operating requirements by simply changing the wedge, and hence the contour. By substituting wedges of various contours in contact driver 110', the contours of conductors 134' and 142' are changed, thereby altering the operating characteristics of the contact driver.

In this embodiment of the invention, wedge 162' is shown constructed of plastic. However, it will be appreciated by those skilled in the art that wedge 162' need not comprise plastic, but need only be insulated to prevent electrical short-circuiting between conductors 134' and 136'. Further, while a magnetic yoke has been illustrated in both embodiments of the invention (i.e., 140 and 140' in FIGS. 4–6 and 7–8, respectively), it will be appreciated by those skilled in the art that this yoke operates only to enhance the repulsive forces $F_1$ and $F_1'$ established between the parallel conductors in response to a current pulse, and may be optionally eliminated from the contact drivers.

There are thus provided multiple embodiments of a high speed contact driver, each of which is relatively faster, simpler, more reliable, and more easily adaptable to different operational requirements than those in the prior art.

While preferred embodiments of the invention have been illustrated and described, it will be clear that the invention is not so limited. Numerous modifications, changes, variations, substitutions and equivalents will occur to those skilled in the art without departing from the spirit and scope of the present invention. For example, while exemplary materials have been described and illustrated throughout, they are characterized by their relevant properties, and materials of similar properties may be substituted therefor. Accordingly, it is intended that the invention herein be limited only by the scope of the appended claims.

What is claimed is:

1. A contact driver comprising:

a wire for conducting a main current;

means connected to said wire for interrupting the flow of electrical current therethrough;

a pair of series-connected, elongate, generally opposing electrical conductors, each of said conductors bowed along a predetermined contour in generally opposing directions when said wire is conducting said main current; and circuit means connected to said electrical conductors for providing a current pulse of predetermined magnitude thereto;

said electrical conductors connected between said circuit means and said current interrupting means such that said current pulse causes said pair of electrical conductors to electromagnetically repulse one another and cause said current interrupting means to interrupt the flow of said main current through said wire.

2. The high speed contact driver of claim 1 wherein said current interrupting means comprises:

a pair of spaced apart stationary contacts connected to said wire so as to interrupt said main current; and a movable bridging contact connected to said pair of electrical conductors and adapted to bridge said pair of stationary contacts.

3. The high speed contact driver of claim 2 wherein said electrical conductors each comprise relatively stiff wire bowed in said predetermined contour.

4. The high speed contact driver of claim 2 wherein:

said electrical conductors each comprise flexible wire; and an insulated wedge is disposed between said electrical conductors for establishing said predetermined contour.

5. A contact driver comprising:

a frame;

a pair of spaced-apart stationary contacts fixed relative to said frame;

a pair of elongate generally opposing electrical conductors each connected at a first end to said frame, said conductors connected in series proximate their second ends;

a bridging contact connected proximate said second ends of said electrical conductors and adapted to be moved between a closed position bridging said stationary contacts and an open position spaced from said stationary contacts;

each of said electrical conductors bowed in a predetermined generally opposing contour when said bridging contact is in said closed position; and circuit means connected to said pair of electrical conductors for providing a current pulse of predetermined magnitude thereto.

6. The high speed contact driver of claim 5 wherein said electrical conductors each comprise relatively stiff wire bowed in said predetermined contour.

7. The high speed contact driver of claim 5 wherein:

said electrical conductors each comprise flexible wire; and an insulated wedge is disposed between said electrical conductors for establishing said predetermined contour.

8. The high speed contact driver of claim 7 and further including means for biasing said bridging contact into bridging position between said pair of stationary contacts.

9. The high speed contact driver of claim 5 and further including a ferrous yoke surrounding at least a portion of said conductors.

10. A contact driver comprising:

a pair of stationary contacts for conducting a main current;

a generally U-shaped frame fixed relative to said stationary contacts and having a base end spaced therefrom;

a pair of elongate, generally opposing elelctrical conductors each fixed at a first end to said base end of said frame, said electrical conductors connected in series proximate their second ends;

a magnetic yoke at least partially surrounding said electrical conductors;

a bridging contact connected proximate said second ends of said pair of electrical conductors and adapted to be moved between a closed position bridging the space between said stationary contacts and an open position spaced from said contacts;

said pair of electrical contacts each bowed in a predetermined generally opposing contour when said bridging contact is in said closed position; and circuit means connected proximate the first ends of said electrical conductors for providing a pulse of electrical current to said electrical conductors.

11. The high speed contact driver of claim 10 wherein said electrical conductors each comprise wire of sufficient stiffness to maintain said predetermined contour.

12. The high speed contact driver of claim 10 wherein:

said electrical conductors each comprise flexible wire; and an insulated wedge is disposed between said electrical conductors for establishing said predetermined contour.

13. The high speed contact driver of claim 12 and further including means for biasing said bridging contact into said closed position.

* * * * *